US011399691B2

(12) United States Patent
Bruno et al.

(10) Patent No.: US 11,399,691 B2
(45) Date of Patent: Aug. 2, 2022

(54) AUTOCALIBRATING DOSING METHOD

(71) Applicant: SEKO S.p.A., Rieti (IT)

(72) Inventors: Maurizio Jafet Bruno, Rieti (IT); Luigino Esposito, Rieti (IT); Adrio Pantaleoni, Rieti (IT)

(73) Assignee: SEKO S.p.A., Rieti (IT)

( * ) Notice: Subject to any disclaimer, the term of this patent is extended or adjusted under 35 U.S.C. 154(b) by 281 days.

(21) Appl. No.: 15/744,281

(22) PCT Filed: Jul. 21, 2016

(86) PCT No.: PCT/IB2016/054348
§ 371 (c)(1),
(2) Date: Jan. 12, 2018

(87) PCT Pub. No.: WO2017/013614
PCT Pub. Date: Jan. 26, 2017

(65) Prior Publication Data

US 2018/0199790 A1 Jul. 19, 2018

(30) Foreign Application Priority Data

Jul. 21, 2015 (IT) ..... 102015000036540

(51) Int. Cl.
*A47L 15/00* (2006.01)

(52) U.S. Cl.
CPC ..... *A47L 15/0055* (2013.01); *A47L 2301/08* (2013.01); *A47L 2401/07* (2013.01);
(Continued)

(58) Field of Classification Search
CPC ..... A47L 15/0055; A47L 2301/08; A47L 2401/07; A47L 2401/12; A47L 2401/30; A47L 2501/07
See application file for complete search history.

(56) References Cited

U.S. PATENT DOCUMENTS 4,211,517 A * 7/1980 Schmid ..... A47L 15/449 137/392
4,509,543 A * 4/1985 Livingston ..... A47L 15/4293 134/113

(Continued)

FOREIGN PATENT DOCUMENTS

DE 295 11 175 1/1996
DE 196 52 733 6/1998

(Continued)

OTHER PUBLICATIONS

International Search Report dated Nov. 8, 2016 issued in PCT International Patent Application No. PCT/IB2016/054348, 2 pp.

*Primary Examiner* — Alexander Markoff
(74) *Attorney, Agent, or Firm* — Nixon & Vanderhye P.C.

(57) ABSTRACT

A dosing method for dosing a chemical product, particularly a detergent, in a dishwasher includes detecting a first loading signal of a washing liquid in a washing tank of the dishwasher; dosing a first quantity of chemical product in the washing liquid to obtain a washing mixture; detecting a conductivity value of the washing mixture at a first loading condition of the dishwasher; storing a conductivity threshold value equal to the conductivity value of the washing mixture at a first loading condition; and dosing of a further quantity of chemical product in the washing mixture at an operation condition of the dishwasher in such a way to adjust a further conductivity value of the washing mixture detected in the operating condition until reaching the conductivity threshold value.

7 Claims, 1 Drawing Sheet

(52) U.S. Cl.
CPC ..... *A47L 2401/12* (2013.01); *A47L 2401/30* (2013.01); *A47L 2501/07* (2013.01)

(56) References Cited

U.S. PATENT DOCUMENTS 4,733,798 A * 3/1988 Brady ..... A47L 15/0055 222/23
4,756,321 A 7/1988 Livingston et al.
5,448,115 A * 9/1995 Howland ..... A47L 15/0055 134/113
5,500,050 A * 3/1996 Chan ..... A47L 15/0055 134/18
6,152,327 A * 11/2000 Rhine ..... A47L 15/4418 141/330
6,463,940 B1 * 10/2002 Thomas ..... A47L 15/0055 134/113
8,424,345 B2 * 4/2013 Park ..... D06F 34/22 68/3 R
8,778,090 B2 * 7/2014 Fuglein ..... A47L 15/0055 134/25.2
2002/0117187 A1 * 8/2002 Helminger ..... A47L 15/0055 134/18
2003/0127110 A1 * 7/2003 Reichold ..... A47L 15/0081 134/25.2
2004/0088075 A1 * 5/2004 Batcher ..... G07C 3/08 700/225
2004/0236522 A1 11/2004 Howes, Jr. et al.
2005/0096788 A1 * 5/2005 Peterson ..... A47L 15/0055 700/244
2006/0216217 A1 * 9/2006 Chan ..... D06F 34/22 422/218
2009/0165823 A1 * 7/2009 Brown ..... A47L 15/0002 134/18
2010/0006122 A1 * 1/2010 Brown ..... A47L 15/0002 134/25.2
2011/0017235 A1 * 1/2011 Berner ..... A47L 15/50 134/18
2012/0037187 A1 * 2/2012 Fuglein ..... A47L 15/0055 134/18
2012/0291808 A1 * 11/2012 Monsrud ..... B08B 3/02 134/18
2015/0136179 A1 * 5/2015 Carlhoff ..... A47L 15/0055 134/18

FOREIGN PATENT DOCUMENTS

EP 117471 B * 10/1987 ..... G01N 27/07
WO WO 2008/095109 8/2008
WO WO 2013/087100 6/2013

* cited by examiner

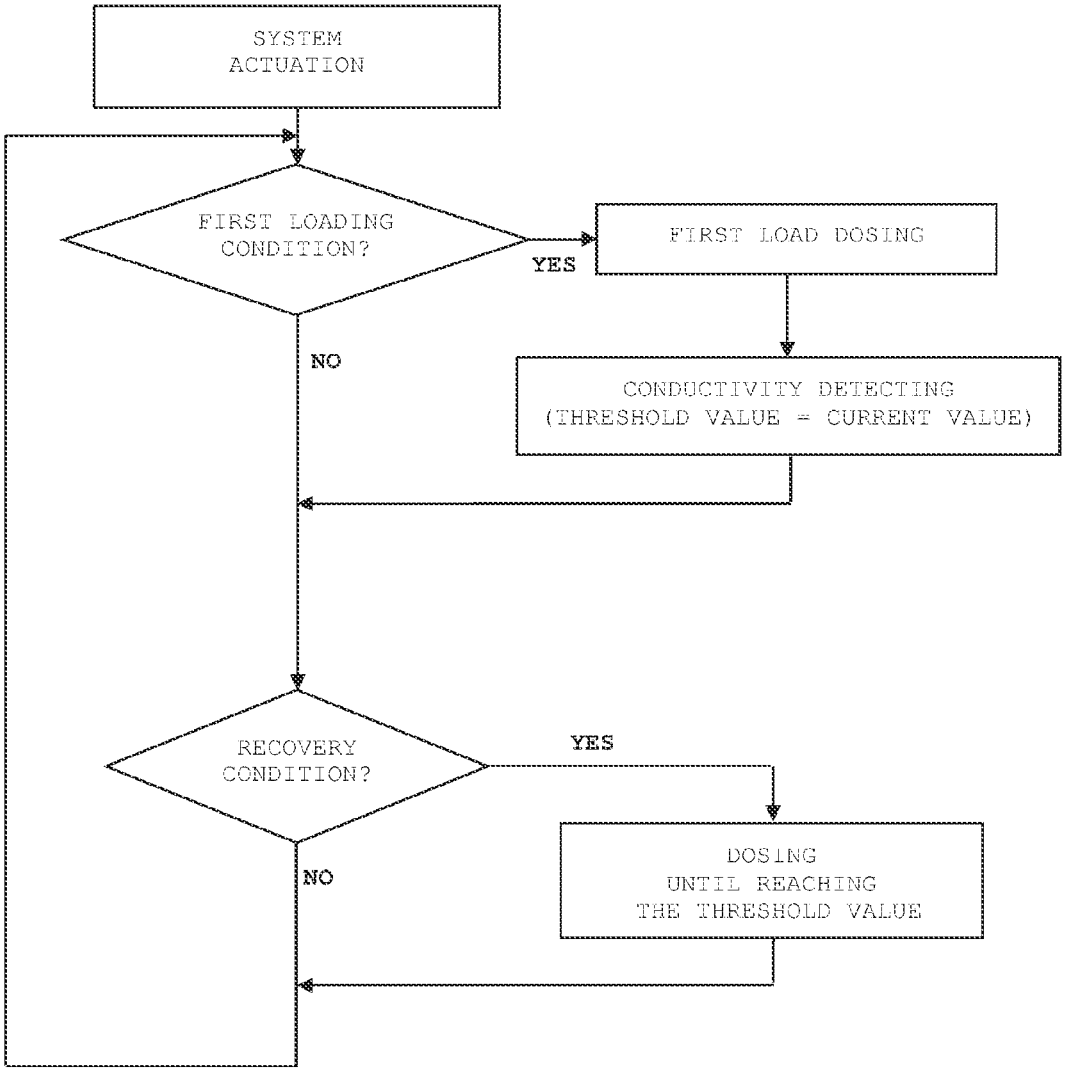
SYSTEM ACTUATION
FIRST LOADING CONDITION?
YES
FIRST LOAD DOSING
NO
CONDUCTIVITY DETECTING (THRESHOLD VALUE = CURRENT VALUE)
RECOVERY CONDITION?
YES
DOSING UNTIL REACHING THE THRESHOLD VALUE
NO

AUTOCALIBRATING DOSING METHOD

This application is the U.S. national phase of International Application No. PCT/IB2016/054348 filed Jul. 21, 2016 which designated the U.S. and claims priority to Italian Patent Application No. 102015000036540 filed Jul. 21, 2015, the entire contents of each of which are hereby incorporated by reference.

The present invention relates to a dosing method, in particular an autocalibrating dosing method calibrated apt to automatically calibrate the amount of the chemical to be inserted into a washing tank, which allows in a simple, reliable, efficient and economical way to drastically reduce the chemical product waste during the operation of a dishwasher.

It is known that in the field cleaning and disinfection of dishes, the dishwashers machines allow both the treatment exclusively with water, that the addiction of concentrated chemicals, such as detergents, rinse aid and sometimes of additives.

Such kind of machines include apparatus for the mixing of the various substances with water, such as metering pumps that are activated for the dosing (i.e. the time delivery) of a specific chemical product amount. These products must be dosed and inserted into the washing cycle at a specific phases of the cycle and in the appropriate amount.

As regards the dosing operation of the cleaner, this is usually carried out in two distinct steps of the washing phases.

A first detergent dosing is carried out at the so-called "first load", i.e. at the first load of water in the dishwasher. A further dosing of detergent, so-called "recovery", is made at the end of each washing subsequent to the first, or periodically, depending on the specific functioning conditions of the dishwasher.

The dosing and insertion operations of the detergent related to the first load can be activated either by reading an electric signal provided by the dishwashing machine (automatic dosing), and by the pressure, by the operator, of a specific key on the dosing device (manual dosing).

In order to determine the chemical product amount which must be dosed at the "first loading" condition, specific parameters are set on the dosing device, for example, the tank capacity and the detergent concentration to be obtained, in such a way that, by the knowledge of the flow rate of the detergent dosing pump, at each first load the dosing device activate the pump for the time necessary to pour in the tank the quantity of product required to reach the chemical concentration in water suggested by the manufacturer of the detergent, according to the preset parameters.

At the end of each washing cycle, or periodically, as mentioned above, a recovery operation by the provision of a further amount of detergent must be carried out in order to compensate the detergent used in the preceding washing and in order to consider the not soapy water added in the tank during the rinsing operation.

The rinsing operation is an automatic operation that is initiated as a function of certain parameters preset by an operator on the dosing system.

In the so-called single tank machines, wherein the washing and the rinsing operations are temporally subsequent between each other in the same environment, the recovery operation is performed at the end of each washing cycle, immediately after the rinsing, so as to restore the correct concentration in the tank for the subsequent washing.

In the so-called tunnel machines, wherein the washing and the rinsing operations take place simultaneously in two distinct environments, sharing the same lower tank, the recovery operation is carried out periodically, according to the average time of a washing cycle.

In both cases, the dosing system must be able to determine the amount of product to dose to determine the optimal conditions for the subsequent washings, and this is function of the reading of some electrical signals coming from the machine and the measure of some chemical/physical characteristics of the water in the washing tank.

The patent application U.S. Pat. No. 4,756,321 describes a detergent and rinse aid dosing method based on a detection of the washing liquid conductivity at the end of each washing cycle and on a logarithmic scale transformation of the conductivity value of concentrated chemical product to allow an easier adjustment by an operator, who must intervene in the system.

The international application WO2008095109 describes a controlling method for a chemicals dispensing device of based on the measurement of the washing liquid conductivity value during the dispensing of the detergent at each washing cycle.

However, the dosing methods of the prior art suffer from certain drawbacks.

The sensors apt to detect the chemical/physical characteristics of the water in the washing tank, for example a detecting probe for the detection of the conductivity or concentration of detergent inside the washing tank, are subject to degradation and/or residues accumulation which may distort the measurement of the actual revealed value. The risk of degradation and/or residues accumulation on the probe obviously increases as the number of the performed washing cycles increases.

Moreover, the measures revealed by the sensors are dependent also on the dissolution quality of the detergent inserted in the water which is not always optimal and which depends on numerous factors, such as the specific water feature (more or less calcareous) or the higher or lower amount of fat located on the crockery of a specific washing cycle.

A drawback of the known dosing methods is that the conductivity value detected by the dosing system at each washing cycle, as well as by the amount of dosed detergent, may be influenced by factors such as the specific water quality, the specific degree of the probe cleaning, the specific degree of calibration of the probe reading, factors that can also greatly vary between a specific washing cycle and another.

Therefore, in the prior art, the washings subsequent to the first one, can be carried out in the not optimal mixing conditions between detergent and water, affecting the system efficiency and the washing quality.

In fact, the conductivity value detected in the tank is typically compared with a fixed threshold value, manually set by the operator on the dosing system and which, therefore, does not consider the real characteristics internal to the washing tank. Therefore, in the case of soiling of the probe for example, the measurement of the detergent conductivity or concentration value internal to the washing water will be less than the real one, and the delivery pump will be actuated to dispense a quantity of detergent considerably higher than the necessary.

An excess of detergent can cause foam excesses with possible leakage of water from the machine, resulting in waste of material and highly polluting situations.

In the prior art dosing methods manual intervention of an operator are provided for the recovery of malfunctioning due to not effective washing operations. The manual intervention of an operator often requires a further use of detergent, a further loading of water, and in any case entails unoperational time thus increasing the cost of the entire process.

An incorrect detergent dosage could also produce an increasing of the solid residues not only on the crockery but also inside the machine, resulting in an acceleration of the damage phenomena of the machine. In fact, because of too high detergent doses, some solid detergent clusters could be created, which are deposited inside the dishwasher and which could clog the components of the water circuit by means of clusters that harden over time causing various kinds of malfunctioning.

Therefore, the detergent dosing phase is an extremely delicate phase of the entire washing process, both as regards the washing performance, but also as regards the safety of the machine.

Therefore, the technical problem posed and solved by the present invention is to provide a detergent dosing method which allows to obviate the drawbacks mentioned above with reference to the prior art.

This problem is solved by a dosing method according to claim 1.

Preferred features of the present invention are shown in the dependent claims.

Advantageously, the object of the present invention allows to preserve the integrity of the dishwasher by means of the possibility of autocalibration of the detergent dosing device.

A further advantage is the possibility of increasing the efficiency of the washing cycle.

A still further advantage is the possibility to preserve the integrity of the dishwasher and greatly decrease the necessity of manual intervention thereby reducing the process costs.

Other advantages, features and the modes of employ of the present invention will become evident from the following detailed description of some embodiments, given by way of not limiting examples.

FIG. 1 is a flow diagram of a preferred embodiment of the present invention.

The present invention will be now described, for illustrative but not limitative purposes, according to its preferred embodiments, with particular reference to FIG. 1 of the accompanying drawing, in which a flow diagram of a preferred embodiment of the present invention is shown.

As shown in FIG. 1, the method according to a preferred embodiment of the present invention includes a first step of verification of the first load condition, which occurs when the empty tank of the dishwasher is filled with clean water, which—for an industrial dishwasher—take place typically every morning or, in some cases, even several times per day.

The verification of the first loading condition occurs by means of the detection of a first load signal of a washing liquid in a tank of the dishwasher.

In particular, such detection can be done in different ways, depending on the specific kind of dishwasher.

For example, in the "double solenoid valve" dishwasher there is a solenoid valve for the water loading: the system receives as input the same actuating signal of this electromagnetic valve and so detects the first load condition.

Instead, in the "single solenoid valve" dishwasher, the same solenoid valve is used both for the rinse and for the first load. In this case the system detects the first loading condition according to the duration of the actuation of the sole available solenoid valve: a short-term actuation (duration less than a specific time threshold) is indicative of a rinsing phase, while an actuation of long duration (higher than the specific threshold time duration) is indicative of a first loading phase. Typically, this time threshold is preset on the dosing system.

In each case, the user may force a first loading condition, by pressing a specific key on the dosing system, provided that this option has not been disabled in the programming of the system.

As a further safety constraint, in some systems, even once the first loading condition has been identified, the dosage of the chemical product does not start until the same conductivity probe does not determine the presence of water in the washing tank (for example, the same probe is able to discriminate between air, water and soapy water).

Finally, in further embodiments, the conductivity probe also incorporates a temperature probe. Therefore, in some systems the effective dosage is also influenced by the fact that the water in the tank has reached a certain temperature, for example to allow activation of the rinse aid, which is usually mixed with the washing water.

Thus, for example, the detection of a first loading signal of a washing liquid comprises, alternatively:

- an acquisition of a solenoid valve activation signal;
- a combined acquisition of a solenoid valve activation signal and the presence of water in the washing tank;
- a combined acquisition of a solenoid valve activation signal, the presence of water in the wash tank and a water temperature exceeding a predetermined temperature threshold; or
- the detection of a manual pressure of a key external to the machine, by an operator.

The dosing phase related to the first loading comprises a step of insertion in the tank of a specific amount of detergent—defined in grams/litre by the manufacturer of the chemical product—previously inserted in the water of the tank.

In particular, to allow the dissolution of the detergent in the water and not compromise the efficiency of the dishwasher functioning, it is necessary not exceed the recommended detergent amount while, to not compromise the washing quality, it is appropriate not dose amount lower than that recommended.

Once the dosage relative to the first load, the washing mixture in the tank, for example comprising the first water loading and the dosed detergent, it is in the ideal condition to perform the washing of the crockery.

However, once the first washing—subsequent the first loading—has been carried out, it is necessary to perform a new detergent dosing into the tank.

In fact, the cleaning power of the washing mixture decreases at the end of the first washing and a recovery phase of the detergent, or an additional detergent dosing phase, is required to restore the washing mixture in the ideal detergent concentration conditions.

A first phenomenon which determines a reduction of the cleaning power of the washing mixture is the chemical combination of a part of the detergent with the residues located on the crockery.

A further phenomenon of cleaning power reduction of the washing mixture is due to the relapse in the tank of the water washing water used for rinsing the crockery, which further dilutes the detergent initially present in the tank.

To compensate for these two factors, after each washing (or periodically), it is therefore necessary to perform a reset via an additional dosing of detergents in the tank.

According to the innovative method here described, immediately after the dosing relative to the first load, when the mixture present in the tank is in the ideal conditions for washing, an acquisition step of the conductivity value of the washing mixture, by the dosing system, is provided, which will be used after as a reference conductivity value.

The reference conductivity value acquired is stored as a threshold value of the conductivity of the mixture.

Preferably, the method according to the invention refers to the use of a detergent or chemical liquid instead of a detergent or chemical powder product.

Advantageously, the use of a liquid product allows a certain and absolute assessment of the amount of product added at the first loading of water in the dishwasher and thus enables a reliable evaluation, if not certain and absolute, of the conductivity value detected and used as reference and threshold value in the method according to the present invention.

Therefore, advantageously, once poured into the tank the amount of detergent defined by the detergent manufacturer, during the first loading phase, the liquid in the tank reaches a conductivity value that can be automatically read by a probe, immediately after the dosage, and subsequently used as a reference for the restore.

In this way, the method according to the present invention allows to decouple the measurement of the conductivity of the washing mixture by parameters such as, for example, the water quality, the cleaning degree of the probe, the reading specific calibration.

In particular, the reference conductivity value (the acquired value is stored and used only up to the next first load which will occur, for example, at the latest, 24 hours after, and is replaced with a new updated value at each further first load).

The use of the reference conductivity value (threshold conductivity value) only for the further dosing carried out in washing cycles subsequent to the first, and until the next first loading, has the advantage of making the system independent from factors that could instead distort the conductivity measurement carried out, and then the dosage of the detergent (as in the case in which the reference conductivity value is set once and for all by the operator and indefinitely used for all washings).

In fact, during a single washing session—comprising a first loading step of water into the washing tank (first load), and a plurality of consecutive washing cycles—these factors can be considered invariant (for example the same water, the same cleaning degree of the probe, the same system calibration condition) and then it could be sure that a detection of the same conductivity value in the tank at every washing indicates an identical concentration of the detergent.

Therefore, advantageously, thanks to the method according to the present invention, the frequency of the probe cleaning interventions, required to maintain unchanged over time the quality of the washings carried out, is reduced.

Furthermore, the need for evaluation of the quality of water used for washing is reduced, very important element in those areas that are served by different aqueducts at different days, and even more for the cruise ships that load the water for their tanks at different ports.

As regards the calibration of the system, in case of reprogramming the system to increase or decrease the amount of chemical product used (for example in the case in which in a day loads of heavily soiled or, on the contrary, slightly soiled crockery are provided), it is sufficient to change just one parameter of the system to provide the regime status of the whole system, for example the concentration of chemical product to be obtained in the tank.

Advantageously, in fact, by increasing, the amount of detergent metered in the first load, simultaneously also the conductivity value, that the system automatically reads again at the end of the first load, rises, and then the amount of chemical to be dosed at each recovery increases automatically, without the need to program any other parameter.

The method according to the present invention is applicable both in the so-called "single tank" machines and in the so-called "tunnel" machines, as will be better described below.

In particular, in the single tank machines, in which the washing and rinsing phase follow each other temporally in the same environment, the recovery should be carried out immediately after the rinsing step of the first washing, so as to restore the correct concentration in the tank for the subsequent washing.

In the "tunnel" machines, which have two distinct environments respectively for washing and rinsing, but sharing the lower tank, the recovery should be carried out periodically, taking into account the average time of a washing cycle.

Both in the single tank dishwasher and in the tunnel dishwasher, a dosing system of a chemical product can be integrated, according to a further aspect of the present invention, which includes a dispensing device configured to dispense a specific quantity of detergent, sensor means for measuring a conductivity value at a first load of the dishwasher and a processing unit configured to perform the dosing method here described.

In particular, at a recovery phase, the method according to the present invention actuates the detergent delivery means, for example a dosing pump. During the detergent delivering, sensor means, for example a detection probe, detect the conductivity value of the washing mixture and the detergent is interrupted at a detection of a conductivity value equal to the stored first loading conductivity value.

Therefore, the method according to the present invention—as well as the dosing system—is defined as autocalibrating. The dosing calibration is in fact carried out automatically at every first loading, by reading and storing again as new threshold value the conductivity value read in the specific day, in the specific cleaning conditions of the probe and according to the water quality available at that specific time.

Advantageously, the method according to the present invention comprises a dosing calibration step, subsequent to the first load, univocally based on the threshold value of the conductivity detected—automatically and without the operator intervention—at the first load.

Contrary to the prior art methods, the operator is not required to determine and manually set the conductivity value to be achieved at each restoring operation, reducing to the minimum the parameters to be programmed for the dosing system configuration and disengaging from the other factors (first of all the cleaning of the probe and the water quality) that may determine different conductivity values at different days, despite having the same quantity of dosed chemical products.

In the case in which the operator should intervene during the machine operating, or also in a phase in which the first load has already been performed, it is possible to intervene on the dosing system by means of the variation of a single parameter percentage to more easily change the amount of chemical product to be dispensed to the subsequent product recovery.

In particular, defined as 100% the amount of chemical product to be dosed to achieve the same conductivity value of the first load, by means of a change of this value, i.e. by increasing or decreasing this value, it is possible to dose a greater or lesser amount of the chemical product at the subsequent recovery, simply by reducing or increasing the same percentage of the conductivity value that must be reached in the tank to stop the detergent delivery by the dosing pump.

Therefore, advantageously, the invention according to the present invention allows to manage the washing of a single load of dishes more or less soiled with respect to the average soil degree, dosing, for the specific washing, and/or for all the subsequent washing, a quantity of detergent proportionally more or less greater with respect to the standard, all in a very intuitive way for the operator.

The present invention also includes an implementation of the described method via a computer program.

Advantageously, the computer program may be stored on a memory medium, for example readable by means of a programmable electronic device.

Furthermore, the computer program can be implemented through the development of software, which can be supported by any programmable electronic device and stored, for example, directly on the electronic controlling board of the dosing system.

In the above preferred embodiments have been described and variants of the present invention have been suggested, but it is to be understood that the skilled in the art can make modifications and changes, without so departing from the related scope of protection, as defined by the attached claims.

The invention claimed is:

1. An autocalibrating dosing method for automatically dosing a chemical product in a dishwasher having a washing tank during each washing session including a first load of washing liquid into a washing tank and one or more subsequent washing cycles, comprising the steps of:

detecting a first loading signal of the washing liquid in the washing tank of the dishwasher to identify a first loading condition of the dishwasher;

dosing a first quantity of chemical product in said washing liquid to obtain a washing mixture;

automatically detecting with a probe a conductivity value of said washing mixture at said first loading condition of the dishwasher;

automatically storing a conductivity threshold value equal to said conductivity value such that said conductivity threshold value is equal to the conductivity value of said washing mixture at the first loading condition;

detecting the conductivity value of said washing mixture with the probe during said one or more subsequent washing cycles; and dosing an additional quantity of chemical product in said washing mixture when the conductivity value detected by said probe during said one or more subsequent washing cycles falls below said conductivity threshold value in such a way to adjust the conductivity value of said washing mixture until reaching said conductivity threshold value, wherein said conductivity threshold value is used only until a next first loading condition is identified, said detecting of the conductivity value and said dosing to reach said conductivity threshold value serving to decouple a measurement of the conductivity value from water quality and from a cleaning degree of the probe.

2. The dosing method according to claim 1, wherein said dosing step of an additional quantity of chemical product is performed at the end of a rinsing step of the dishwasher.

3. The dosing method according to claim 1, wherein said step of dosing a first quantity of chemical product is performed by delivering a certain amount of chemical product in a certain time interval.

4. The dosing method according to claim 1, wherein a monitoring step of said conductivity value of said washing mixture at an operating condition is performed before said dosing step of an additional quantity of chemical product in said washing mixture at an operating condition.

5. The dosing method according to claim 1, wherein a displaying step of said conductivity value of said washing mixture is provided in a first loading condition detected, on a display screen of a dosing system.

6. An autocalibrating dosing system for automatically dosing a chemical product in a dishwasher having a washing tank during each washing session including a first load of washing liquid into a washing tank and one or more subsequent washing cycles, the autocalibrating dosing system comprising:

a dosing device;

a sensor configured to measure a conductivity value of a washing mixture; and a processing unit configured to perform a dosing method for dosing a chemical product in a dishwasher, comprising the steps of:

detecting a first loading signal of the washing liquid in the washing tank of the dishwasher to identify a first loading condition of the dishwasher;

dosing a first quantity of chemical product in said washing liquid to obtain a washing mixture;

automatically detecting with a probe a conductivity value of said washing mixture at said first loading condition of the dishwasher;

automatically storing a conductivity threshold value equal to said conductivity value such that said conductivity threshold value is equal to the conductivity value of said washing mixture at the first loading condition;

detecting the conductivity value of said washing mixture with the probe during said one or more subsequent washing cycles; and dosing an additional quantity of chemical product in said washing mixture when the conductivity value detected by said probe during said one or more subsequent washing cycles falls below said conductivity threshold value in such a way to adjust the conductivity value of said washing mixture until reaching said conductivity threshold value, wherein said conductivity threshold value is used only until a next first loading condition is identified, said detecting of the conductivity value and said dosing to reach said conductivity threshold value serving to decouple a measurement of the conductivity value from water quality and from a cleaning degree of the probe.

7. A non-transitory computer readable medium having stored thereon computer executable instructions that, when executed by a processing unit, perform an autocalibrating dosing method for automatically dosing a chemical product in a dishwasher having a washing tank during each washing session including a first load of washing liquid into a washing tank and one or more subsequent washing cycles, the autocalibrating dosing method comprising the steps of:

detecting a first loading signal of the washing liquid in the washing tank of the dishwasher to identify a first loading condition of the dishwasher;

dosing a first quantity of chemical product in said washing liquid to obtain a washing mixture;

automatically detecting with a probe a conductivity value of said washing mixture at said first loading condition of the dishwasher;

automatically storing a conductivity threshold value equal to said conductivity value such that said conductivity threshold value is equal to the conductivity value of said washing mixture at the first loading condition;

detecting the conductivity value of said washing mixture with the probe during said one or more subsequent washing cycles; and dosing an additional quantity of chemical product in said washing mixture when the conductivity value detected by said probe during said one or more subsequent washing cycles falls below said conductivity threshold value in such a way to adjust the conductivity value of said washing mixture until reaching said conductivity threshold value, wherein said conductivity threshold value is used only until a next first loading condition is identified, said detecting of the conductivity value and said dosing to reach said conductivity threshold value serving to decouple a measurement of the conductivity value from water quality and from a cleaning degree of the probe.

* * * * *